US005428431A

United States Patent [19]

Abe et al.

[11] Patent Number: 5,428,431

[45] Date of Patent: Jun. 27, 1995

[54] TRANSFER MATERIAL TRANSPORT DEVICE CAPABLE OF EXERTING PROPER TENSION ON A TRANSFER SHEET

[75] Inventors: Takashi Abe; Takeshi Okoshi, both of Saitama, Japan

[73] Assignee: Fuji Xerox Co., Ltd., Tokyo, Japan

[21] Appl. No.: 198,782

[22] Filed: Feb. 18, 1994

[30] Foreign Application Priority Data

Feb. 19, 1993 [JP] Japan ..... 5-030296

[51] Int. Cl.[6] ..... G03G 15/14; G03G 15/00

[52] U.S. Cl. ..... 355/273; 271/245; 355/271; 355/308; 355/317; 355/321

[58] Field of Search ..... 355/204, 208, 271, 273, 355/308, 309, 321, 317; 271/242, 245, 270, 275

[56] References Cited

U.S. PATENT DOCUMENTS

| | | | |
|---|---|---|---|
| 4,541,711 | 9/1985 | Takahashi | 355/208 |
| 4,669,853 | 6/1987 | Sosinski et al. | 355/317 X |
| 4,943,863 | 7/1990 | Ainoya | 355/271 |
| 4,951,095 | 8/1990 | Warden | 355/273 |
| 5,018,718 | 5/1991 | Matsuno et al. | 271/270 X |
| 5,073,802 | 12/1991 | Sugiyama | 271/270 X |
| 5,119,146 | 6/1992 | Nobumori et al. | 355/317 |
| 5,153,661 | 10/1992 | Shimizu et al. | 355/309 |
| 5,159,393 | 10/1992 | Hiroshima et al. | 355/271 X |
| 5,168,290 | 12/1992 | Tanaka et al. | 355/271 X |
| 5,282,001 | 1/1994 | Watson | 355/208 |

FOREIGN PATENT DOCUMENTS 3-186880 8/1991 Japan .

*Primary Examiner*—Matthew S. Smith

*Attorney, Agent, or Firm*—Finnegan, Henderson, Farabow, Garrett & Dunner

[57] ABSTRACT

When an electromagnetic clutch 45 is turned on, a rotating force of a main motor 62 is transmitted to a shaft 42 of a drive roller 41*a* of transport rollers 41 through a double gear 49 and a high-speed gear 46. As a result, the drive roller 41*a* rotates so as to produce a transport speed higher than the circumferential speed of a photoreceptor drum 13, thereby looping a transfer material P. When the electromagnetic clutch 45 turned off, the rotating force of the main motor 62 is transmitted to the shaft 42 through the double gear 49 and a low-speed gear 47. Accordingly, the drive roller 41*a* rotates so as to produce a transport speed lower than the circumferential speed of the photoreceptor drum 13. As a result, the loop of the transfer material P gradually shrinks and finally disappears. The drive roller 41*a* is therefore separated from the main motor 62 by the action of a one-way clutch 48, to follow the rotation of the photoreceptor drum 13 while exerting tension on the transfer material P.

3 Claims, 5 Drawing Sheets

TRANSFER MATERIAL TRANSPORT DEVICE CAPABLE OF EXERTING PROPER TENSION ON A TRANSFER SHEET

BACKGROUND OF THE INVENTION

The present invention relates to a transfer material transport device for forwarding a transfer material (sheet) toward an image transfer section of an image carrying body. More particularly, the invention is directed to a transfer material transport device that causes the transfer material to form a loop at a position immediately before the image transfer section.

In image forming apparatuses such as a copier and a printer, a recorded sheet is produced by forming a toner image on an image carrying body such as a photoreceptor drum by an electrophotographic process, transferring the toner image onto a transfer material such as a sheet in the image transfer section by discharge from a transfer corotron or the like, and then fusing the toner image by a fusing unit.

By the way, in image forming apparatuses such as a printer that do not involve an original document, the exposing timing is adjusted to the timing at which a transfer material reaches the photoreceptor drum. If the speed of the transport of the transfer material by a transport roller toward the photoreceptor drum is lower than the circumferential speed of the photoreceptor drum, large tension is exerted on the transfer material, thereby causing an undesirable misregistration in a transferred image. In particular, if the transfer material is thin paper such as tracing paper, the transfer material itself may be damaged. To solve this problem, in the conventional image forming apparatuses, the transport speed of the transport roller is set at a speed slightly higher than the circumferential speed of the photoreceptor drum.

However, where the transport speed of the transport roller becomes higher than the circumferential speed of the photoreceptor drum, the transfer material may form a loop in a guide member that is disposed immediately before the image transfer section. This increases the incidence of skewing of the transfer material. In particular, image deletions and wrinkles are likely to occur in the case where the transfer material is long. To prevent the occurrence of image deletions, there has been proposed a method of bending the lower portion of the guide member located immediately before the image transfer section. However, this is not a viable solution because in some cases the transfer material does not completely go along the guide member.

Japanese Patent Application Unexamined Publication No. Hei. 3-186880 ("Transfer Roller Device") discloses a method of giving tension to a transfer sheet by temporarily stopping the operation of a pair of transport rollers at the instant when the paper engages with a transfer pressure contact portion, to thereby prevent transfer defects.

However, in this method, tension (back tension) is suddenly exerted on the transfer material upon the suspension of the operation of the transport rollers, which causes the transfer material to slip with respect to the photoreceptor drum, to generate a misregistration in an image.

SUMMARY OF THE INVENTION

The invention has been made in view of the above circumstances, and has an object of providing a transfer material transport device which can prevent occurrences of a positional deviation of a transfer material, a misregistration in an image, an image deletion and a wrinkle, without abruptly giving tension to the transfer material.

According to the invention, a transfer material transport device comprises:

transport means for forwarding a transfer material toward an image transfer section of an image carrying body;

speed control means for controlling the transport means so that a transfer material transport speed of the transport means is set higher than a circumferential speed of the image carrying body, to thereby form a loop in a head portion of the transfer material; and tension generating means for switching the transfer material transport speed of the transport means to a speed lower than the circumferential speed of the image carrying body to shrink the loop and to exert tension on the transfer material upon disappearance of the loop.

DETAILED DESCRIPTION OF THE PREFERRED EMBODIMENT

An embodiment of the present invention will now be described with reference to the accompanying drawings.

Figure 2:
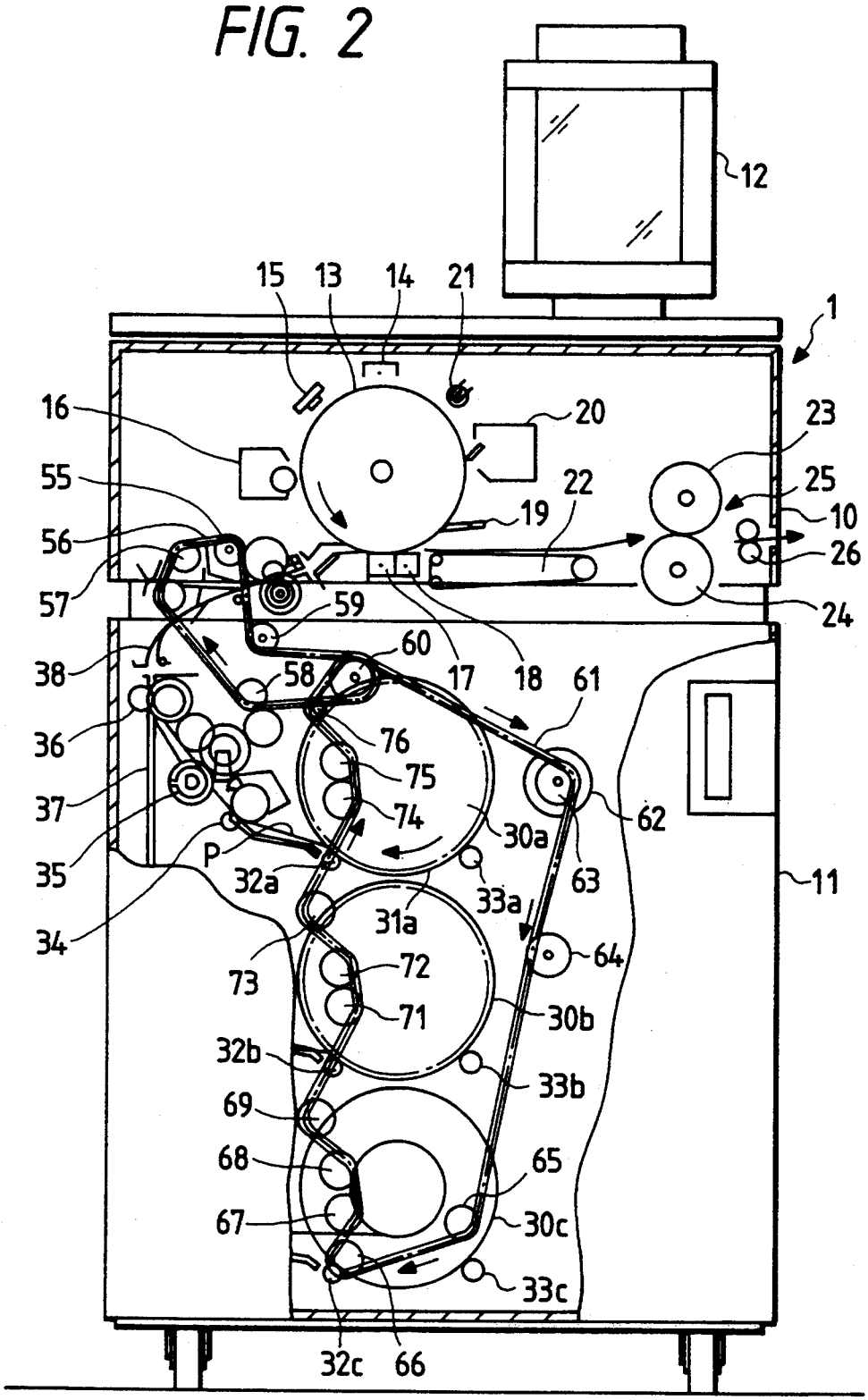
FIG. 2 is a sectional view showing the general configuration of the printer shown in FIG. 1.

FIG. 2 shows the general configuration of a printer 1 having a transfer material transport device according to an embodiment of the invention.

The printer 1 is constructed in such a manner that a printer main body 10 is placed on a roll paper feeder 11. On the top surface of the printer main body 10 is a display (CRT display) 12, which displays the size of roll paper in use and operational conditions (the remainder of the roll paper, an occurrence of jamming, etc.).

The printer main body 10 has a photoreceptor drum 13 serving as an image carrying body. The photoreceptor drum 13 can rotate at a predetermined speed in a direction shown by an arrow in FIG. 2 while being driven by a drive mechanism (not shown). Disposed around the photoreceptor drum 13 are: a charging corotron 14 for charging the surface of the photoreceptor drum 13 uniformly, a writing unit 15 for electrostatically writing image data, a developing unit 16 for rendering the written image data into a visible image, a transfer corotron 17 for transferring the thus-obtained toner image onto a transfer material P forwarded from the roll sheet feeder 11, a separating corotron 18 for separating the toner image carrying transfer material P from the photoreceptor drum 13 by discharging, a separating member 19 for mechanically separating the transfer material P, a cleaning unit 20 for removing residual toner particles from the surface of the photoreceptor drum 13, and a charge eliminating lamp 21 for neutralizing the electric charges remaining on the surface of the photoreceptor drum 13. These components are arranged in the order as written above.

The transfer material P that has been subjected to the transfer process is forwarded by a transport unit 22 to a fusing unit 25, where the toner image is thermally fused. The transfer material P is thereafter discharged outside the printer 1 by a discharge roller 26. The fusing unit 25 includes a heating roller 23 and a pressure roller 24.

The roll paper feeder 11 has a three-stage paper feed section, and rolls of paper 30*a* to 30*c* are accommodated in paper feed cassettes of the paper feed section.

The rolls of paper 30*a* to 30*c* are held by circular flanges 31*a* to 31*c* located at both ends of core portions, respectively. The flanges 31*a* to 31*c* are placed on parallel flange carrying rollers 32*a* and 33*a*, 32*b* and 33*b* and 32*c* and 33*c*, and rotate in a direction shown by an arrow in FIG. 2 as the transfer materials P are supplied from the rolls of paper 30*a* to 30*c*.

The transfer material P selectively supplied from the rolls of paper 30*a* to 30*c* is forwarded toward a transport passage 37 by a sheet feed mechanism. The sheet feed mechanism includes a transport roller 34 and a cutter 35 having a fixed blade and a rotary blade. More specifically, after the rolls of paper 30*a*–30*c* have been set, when image data is sent from a computer (not shown) or the like, the selected transfer material P is forwarded by the transport roller 34, cut into a predetermined size by the cutter 35, and then forwarded into the printer main body 10 while ascending the transport passage 37.

Figure 1:
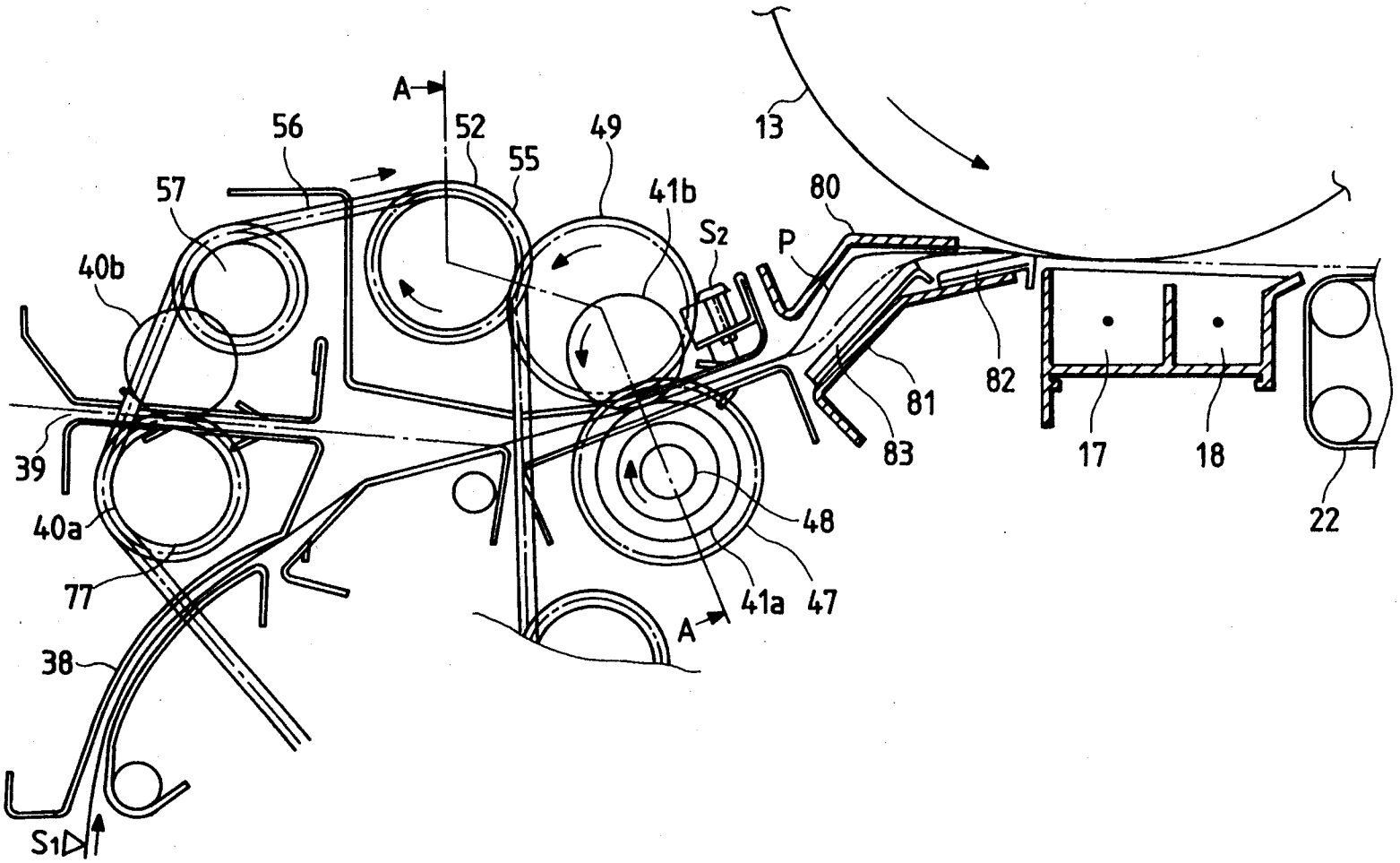
FIG. 1 is a sectional view mainly showing the configuration of a transfer material transport device according to an embodiment of the invention included in a printer.

FIG. 1 shows, in an enlarged manner, the configuration of the image transfer section and components adjacent thereto, most of which are accommodated in the printer main body 10. The transfer material P having ascended along the transport passage 37 is guided toward transport rollers 41 along a guide member 38. A sensor $S_1$, e.g., a photosensor, is disposed at the entrance of the guide member 38 detects the arrival of the head of the transfer material P.

Above the guide member 38 is a manual-feed-sheet inlet 39. A transfer material P inserted through the manual-feed-sheet inlet 39 is forwarded toward the transport rollers 41 by transport rollers 40, i.e., a drive roller 40*a* and an idler roller 40*b*.

The transport rollers 41 consist of a drive roller 41*a* and an idler roller 41*b*. A sensor $S_2$, e.g., a photosensor, for sensing the tail of the transfer material P is disposed downstream of and in the vicinity of the transfer rollers 41.

Between the transport rollers 41 and the image transfer section of the photoreceptor drum 13 is a transfer material guide passage consisting of an upper guide member 80 and a lower guide member 81. The upper guide member 80 is bent so as to protrude upward as viewed from the lateral side, and confines the upper surface of the transfer material P. The lower guide member 81 consists of a head guide portion 82 adjacent to the photoreceptor drum 13 and a base guide portion 83 to guide the transfer material P to the head guide portion 82 obliquely. The transfer material guide passage formed by the head guide portion 82 and the base guide portion 83 is substantially spherical.

The transport speed of the transfer material P by the transport rollers 41 is set higher than the circumferential speed of the photoreceptor drum 13 until the head of the transfer material P reaches the image transfer section, and is thereafter switched to be lower than the circumferential speed of the photoreceptor drum 13 at a predetermined timing. That is, first the transfer material P is looped along the upper guide member 80 as shown by a solid line in FIG. 1, then gradually unlooped, and finally unlooped completely as shown by a two-dot chain line.

Figure 3:
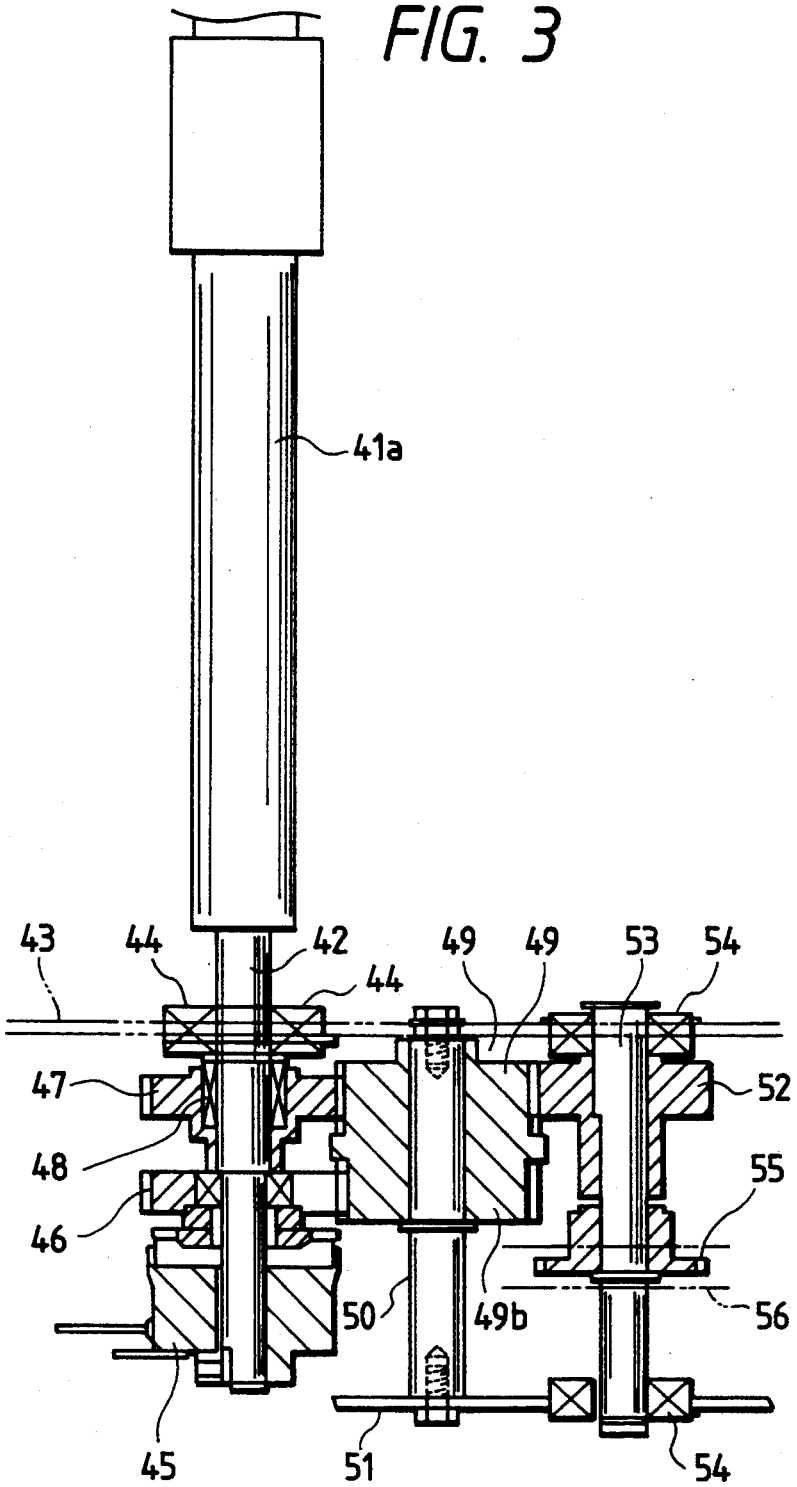
FIG. 3 is a view showing the configuration of a drive mechanism of the transfer material transport device shown in FIG. 1.

FIG. 3 shows in detail a drive mechanism of the drive roller 41*a* of the transport rollers 41. FIG. 3 is a sectional view taken along line A—A in FIG. 1.

A shaft 42 of the drive roller 41*a* is rotatably supported by a frame 43 through a bearing portion 44. A high-speed gear (having 35 teeth) 46 is attached to the shaft 42 through an electromagnetic clutch 45. A low-speed gear (having 36 teeth) 47 is also attached to the shaft 42 through a one-way clutch 48. The gear 47 is meshed with one gear (having 36 teeth) 49*a* of a double gear 49, whereas the gear 46 is meshed with the other gear (having 37 teeth) 49*b* of the double gear 49. The double gear 49 is rotatably supported by a shaft 50.

The gear 49*a* of the double gear 49 is further meshed with a gear (having 31 teeth) 52, which is fixed to a shaft 53. The shaft 53 is rotatably supported by the frame 43 and a frame 51 through respective bearing portions 54. A chain sprocket 55 is further fixed to the shaft 53, and a chain 56 is engaged with the chain sprocket 55.

As shown in FIGS. 1 and 2, the chain 56 is engaged with a sprocket 57, a sprocket 77 that is coaxial with the drive roller 40*a*, a sprocket 58, a double sprocket 60 and a sprocket 59. A chain 61 is also engaged with the double sprocket 60. Sprockets 63 to 76 are engaged with this chain 61, the sprocket 63 being coaxial with a main motor 62.

With the above configuration, as the main motor 62 rotates, the rotating force is transmitted to the double sprocket 60 through the chain 61, and further transmitted to the chain 56 through the double sprocket 60. The rotating force of the chain 56 is transmitted to the shaft 53 through the sprocket 55, whereby the gear 52 is rotated. And this rotating force is transmitted to the gear 49*a* of the double gear 49.

If the electromagnetic clutch 45 is turned on, the rotating force of the main motor 62 is transmitted to the shaft 42 through the gear 49*b* of the double gear 49 and the high-speed gear 46. Accordingly, the drive roller 41*a* of the transport rollers 41 is rotated at a high speed, i.e., at a speed higher than the circumferential speed of the photoreceptor drum 13, to forward the transfer material P to the image transfer section. As a result, the transfer material P is looped. Since in this case the one-way clutch 48 is rotates idly, the drive roller 41*a* is never rotated by the gears 49*a* and 47.

On the other hand, if the electromagnetic clutch 45 is turned off, the rotating force of the main motor 62 is transmitted to the shaft 42 through the gear 49*a* of the double gear 49 and the low-speed gear 47. Accordingly, the drive roller 41*a* of the transport rollers 41 is rotated at a low speed, i.e., at a speed lower than the circumferential speed of the photoreceptor drum 13. As a result, the loop of the transfer material P gradually shrinks and finally disappears. The drive roller 41*a* of the transport rollers 41 is thereafter separated from the drive source (main motor 62) by the action of the one-way clutch 48, and follows the rotation of the photoreceptor drum 13 while exerting tension (back tension) on the transfer material P.

Figure 4:
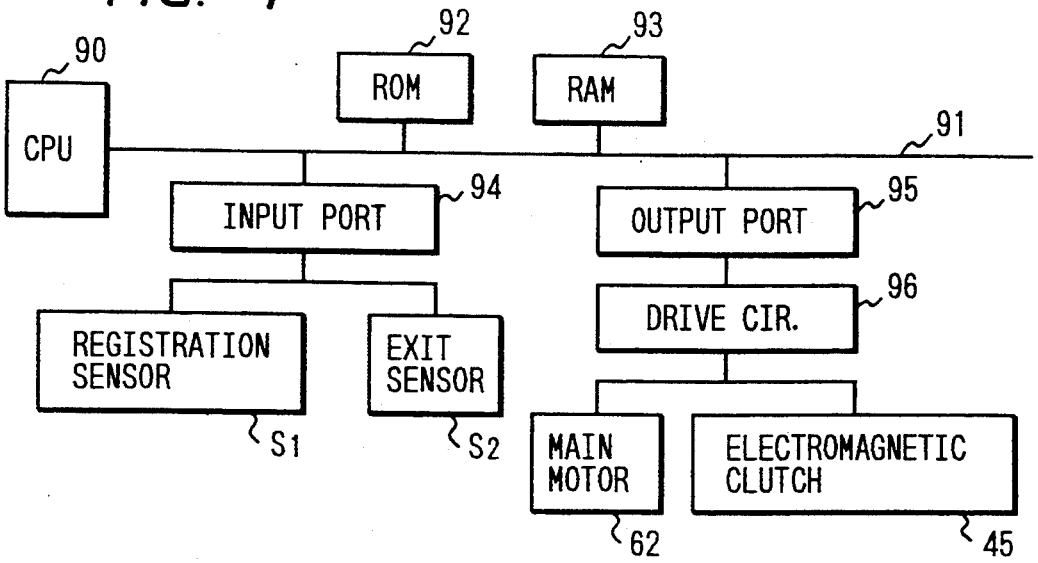
FIG. 4 is a block diagram showing the constitution of a control section of the printer shown in FIG. 1.

FIG. 4 shows the constitution of a control section of the printer 1 of the embodiment. The control section has a CPU 90, which is connected to various parts of the printer 1 through a bus 91. A ROM 92 stores not only a program for controlling the operation of the various parts of the printer 1 but also a program for effecting the transport speed control of the transport rollers 41 as shown in a flowchart FIG. 5 (described later). A RAM 93 temporarily stores various calculation results, various data, etc. An input port 94 is an interface for sending sensing signals from the sensors $S_1$ and $S_2$ to the CPU 90. Receiving those sensing signals, the CPU 90 produces control signals to drive the main motor 62 and the electromagnetic clutch 45. An output port 95 serves to send the control signals output from the CPU 90 to a drive circuit 96. The drive circuit 96 performs on/off control of the electromagnetic clutch 45 and the main motor 62 based on the control signals sent through the output port 95.

Figure 5:
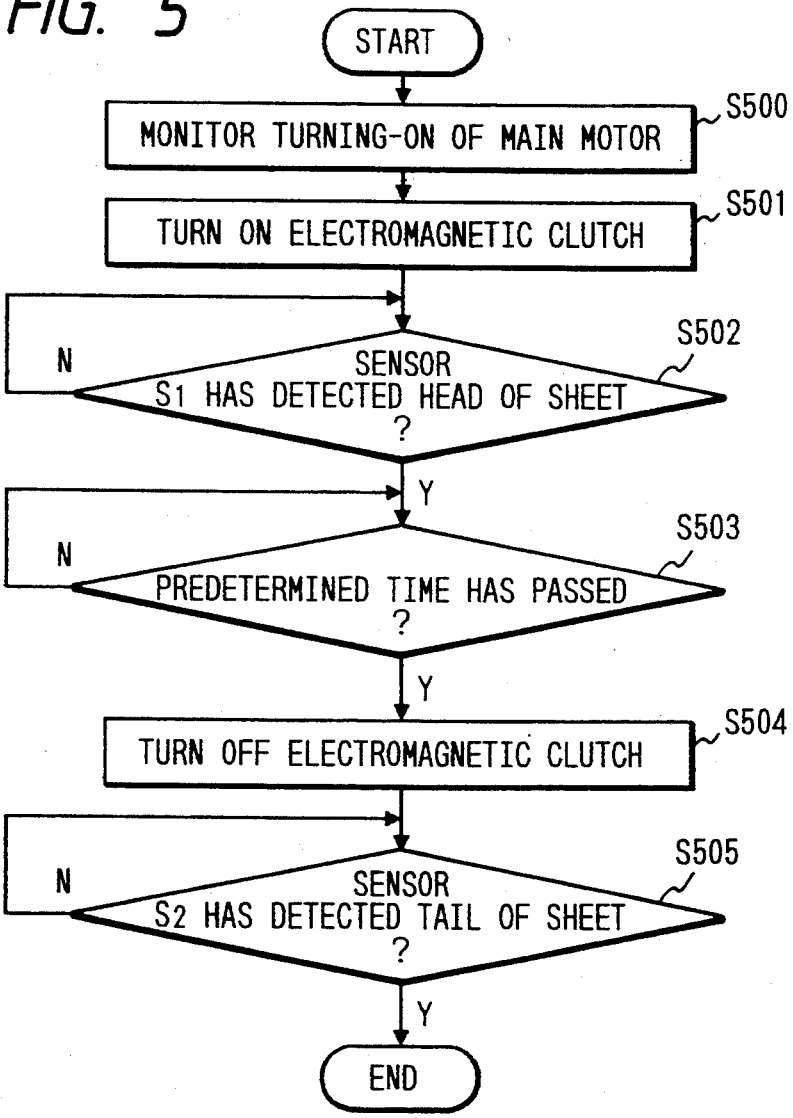
FIG. 5 is a flowchart showing the operation of the printer shown in FIG. 1.
Figure 6:
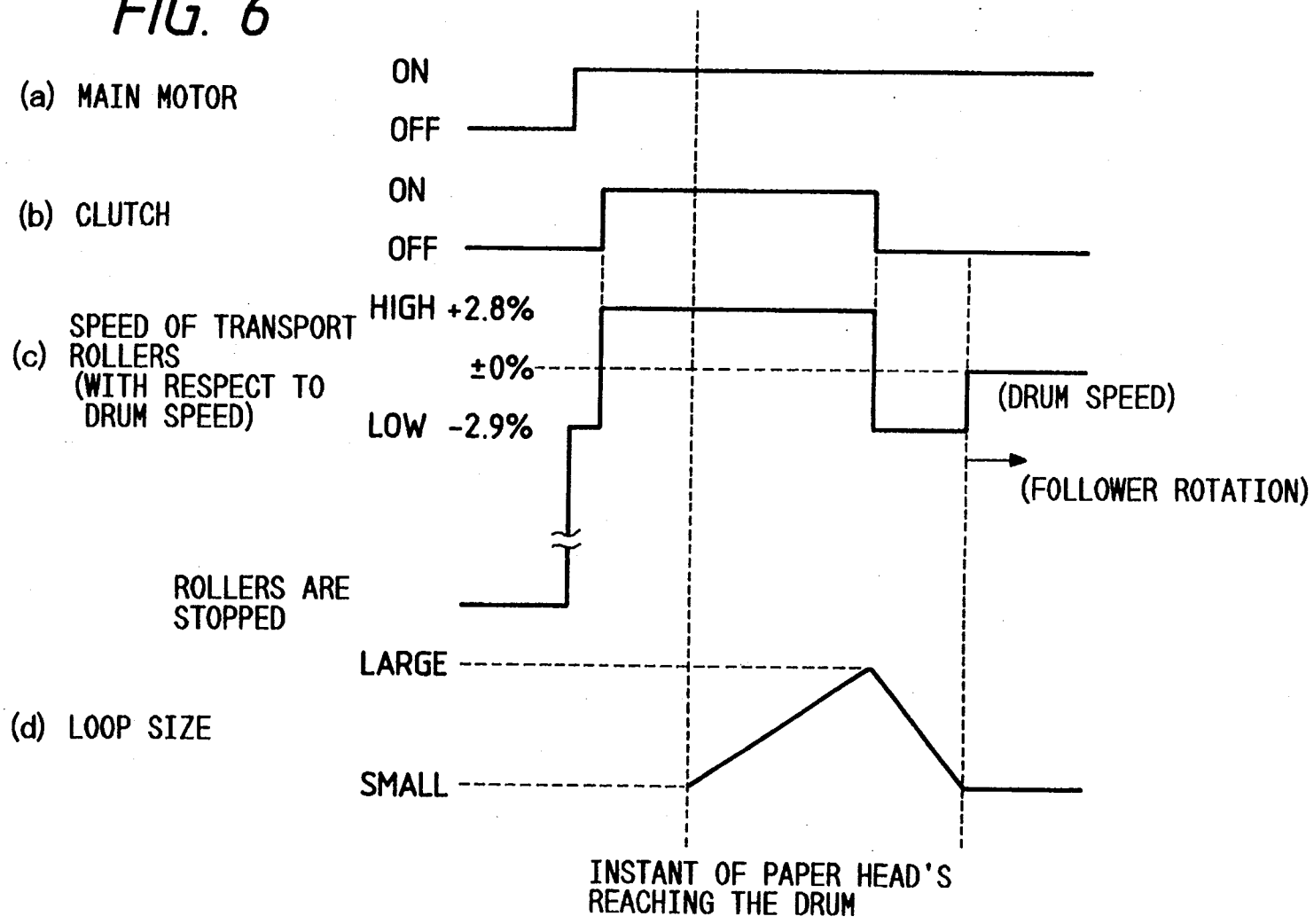
FIG. 6 is a timing chart showing the operation of the printer shown in FIG. 1.

The operation of the printer 1 of the embodiment will be described below with reference to a flowchart shown in FIG. 5 and a timing chart shown in FIG. 6.

The CPU 90 monitors the turning-on of the main motor 62 (Step S500). Upon turning on of the main motor 62, the CPU 90 turns on the electromagnetic clutch 45 (Step S501). When image data is thereafter sent from the computer (not shown) or the like, the transport roller 34 is driven to feed the transfer material P from, for instance, the roll of paper 30*a* selected from the rolls of paper 30*a* to 30*c*. Then, the transfer material P is cut by the cutter 35 into a predetermined size, and forwarded into the printer main body 10 through the transport passage 37.

The transfer material P forwarded up along the transport passage 37 reaches the transport rollers 41 while passing along the guide member 38, and the transport rollers 41 forwards the transfer material P to the image transfer section at the high speed. That is, the rotating force of the main motor 62 is transmitted to the shaft 53 through the chain 61, the chain 56 and the sprocket 55, and further transmitted to the shaft 42 through the gear 52, the gears 49*a* and 49*b* of the double gear 49 and the high-speed gear 46. Accordingly, the drive roller 41*a* of the transport rollers 41 is rotated at a speed higher than the circumferential speed of the photoreceptor drum 13, thereby forwarding the transfer material P to the image transfer section. As a result, the transfer material P is forwarded along the upper guide member 80, thus looping itself as shown by the solid line in FIG. 1.

Then, the CPU 90 judges whether a predetermined time has elapsed after the sensor $S_1$ sensed the head of the transfer material P (Step S503). If the judgment is affirmative, the CPU 90 turns off the electromagnetic clutch 45 (Step S504). Accordingly, the rotating force of the main motor 62 transmitted to the double gear 49 comes to be transmitted to the shaft 42 through the gear 49*a* of the double gear 49 and the low-speed gear 47. The drive roller 41*a* of the transport rollers 41 is rotated at a speed lower than the circumferential speed of the photoreceptor drum 13. As a result, the loop of the transfer material P gradually shrinks and finally disappears. The drive roller 41*a* is thereafter separated from the main motor 62 by the action of the one-way clutch 48, and follows the rotation of the photoreceptor drum 13 while exerting tension (back tension) on the transfer material P. In this case, the transfer material P is guided along the curved surface formed by the head guide portion 82 and the base guide portion 83 of the lower guide member 81. A toner image transferred on the transfer material P from the photoreceptor drum 13 is thermally fused by the fusing unit 25, and the transfer material P is then discharged outside by the discharge roller 26. The CPU 90 ends the control of the transport of the one transfer material P by the transport rollers 41 as soon as the sensor $S_2$ detects the tail of the transfer material P (Step S505).

As described above, in the printer 1 of this embodiment, a loop is formed in the head portion of the transfer material P by making the transfer material transport speed of the transport rollers 41 faster than the circumferential speed of the photoreceptor drum 13, then the loop is gradually reduced by making the transfer material transport speed slower than the circumferential speed of the photoreceptor drum 13, and finally tension (back tension) is generated. Therefore, not only skewing of the transfer material P in the image transfer section can be prevented, but also image deletions, misregistrations in an image and wrinkles can be prevented in a positive manner.

While the invention has been described by way of the embodiment, it is not limited to the above embodiment but may be modified in various modes without deviating from the material concept thereof. For example, while in the above embodiment the tension on the transfer material P is generated by the rotation of the transport rollers 41 following the rotation of the photoreceptor drum 13, such tension may be produced by, e.g., a torque limiter, a felt pad, etc.

As described in the foregoing, in the transfer material transport device of the invention, a loop formed in the head portion of the transfer material P gradually shrinks and finally disappears to exert tension on the transfer material P by first setting the transfer material transport speed of the transport means such as the transport rollers higher than the circumferential speed of the image carrying body such as the photoreceptor drum and then changing, at a predetermined timing, the transfer material transport speed to a speed lower than the circumferential speed of the image carrying body. Therefore, the invention provides the advantages that a positional deviation of the transfer material can be prevented and that image deletions, misregistrations in an image, and wrinkles can be prevented in a positive manner.

What is claimed is:

1. A transfer material transport device comprising:

transport means for forwarding a transfer material toward an image transfer section of an image carrying body;

speed control means for controlling the transport means so that a transfer material transport speed of the transport means is set higher than a circumferential speed of the image carrying body, to thereby form a loop in a head portion of the transfer material; and tension generating means for switching the transfer material transport speed of the transport means to a speed lower than the circumferential speed of the image carrying body, but greater than zero, to shrink the loop and to exert tension on the transfer material upon disappearance of the loop.

2. A transfer material transport device comprising:

a transport roller for forwarding a transfer material toward an image transfer section of an image carrying body;

speed control means for controlling the transport roller so that a transfer material transport speed of the transport roller is set higher than a circumferential speed of the image carrying body, to thereby form a loop in a head portion of the transfer material; and tension generating means for switching the transfer material transport speed of the transport roller to a speed slower than the circumferential speed of the image carrying body, but greater than zero, to shrink the loop and to exert tension on the transfer material by causing the transport roller to follow a rotation of the image carrying body upon disappearance of the loop.

3. A transfer material transport device for continuously forwarding a roll sheet to an image transfer section of an image carrying body by a predetermined length at a speed slightly higher than a circumferential speed of the image carrying body, said transfer material transport device comprising:

a variable speed drive means for the roll sheet for transmitting a drive force to the roll sheet through a one-way clutch, the one-way clutch transmitting drive force from the power source to the rollsheet but not from the roll sheet to the power source;

means for detecting a time instant at which a head of the roll sheet reaches the image transfer section; and means for controlling a speed of the variable speed drive means so that a roll sheet transport speed is made slightly smaller than the circumferential speed of the image carrying body after the detected time instant.

* * * * *